United States Patent [19]

Endrenyi, Jr. et al.

[11] Patent Number: 4,877,669

[45] Date of Patent: Oct. 31, 1989

[54] TUFTED PILE FABRIC

[75] Inventors: Frank Endrenyi, Jr., Chattanooga, Tenn.; Larry W. Hankins, Dalton, Ga.

[73] Assignee: Collins & Aikman Corporation, New York, N.Y.

[21] Appl. No.: 296,490

[22] Filed: Jan. 12, 1989

[51] Int. Cl.[4] ..... B32B 3/02; B32B 33/00

[52] U.S. Cl. ..... 428/88; 428/92; 428/95; 428/97

[58] Field of Search ..... 428/88, 89, 92, 95, 428/97; 156/72; 112/266

[56] References Cited

U.S. PATENT DOCUMENTS 3,396,687 8/1968 Nowicki ..... 112/266

4,119,049 10/1978 Puckett ..... 112/266

4,216,735 8/1980 McDaniel ..... 428/89

4,461,791 7/1984 Matsui ..... 428/89

*Primary Examiner*—Marion C. McCamish

*Attorney, Agent, or Firm*—Bell, Seltzer, Park & Gibson

[57] ABSTRACT

A tufted pile fabric constructed for the formation of carpet tile therefrom and having a diagonal pattern therein extending throughout the fabric. The diagonal pattern is defined by alternately arranged pairs of solid color yarns and spaced dyed yarns tufted in a zig-zag pattern. The tufted pile fabric is tufted to form random variable height loop pile which is thereafter lightly sheared to cut only some of the loops while leaving other loops uncut and some loops partially cut. This shearing visually presents the carpet as a cut pile fabric.

9 Claims, 3 Drawing Sheets

TUFTED PILE FABRIC

FIELD OF THE INVENTION

This invention relates to tufted pile fabrics and more particularly to tufted carpets for the formation of carpet tiles therefrom.

BACKGROUND OF THE INVENTION

As is well known to those familiar with tufted carpet tile, all carpet tile with a pattern present therein has involved the printing of such pattern on the individual tiles. This is an expensive separate process and desirably to be avoided.

SUMMARY OF THE INVENTION

It is therefore the primary object of this invention to provide a tufted pile carpet fabric with a pattern present therein from the tufting operation, and wherein the pattern readily permits carpet tiles of various conventional sizes to be formed therefrom, with the juncture or seam line of adjacent laid tiles substantially obscured when a floor is covered with such tiles.

It is a more specific object of this invention to provide a tufted pile carpet fabric wherein the principal motiff of the pattern present therein is diagonal lines of tufts extending across the fabric and wherein two sets of yarns are present, one set being of solid colored yarns and the other set being of spaced dyed yarns and wherein the two sets of yarns are arranged in alternation diagonally across the fabric. The tufted pile carpet is constructed of variable or irregular height loop pile randomly arranged so that subsequent light shearing of the carpet presents the appearance of cut pile but wherein only some of the pile loop tufts are cut, and other pile loop tufts include both uncut and only partially cut tufts.

DETAILED DESCRIPTION OF THE DRAWINGS

Further objects will be apparent from the specification and drawings in which

DETAILED DESCRIPTION OF THE PREFERRED EMBODIMENT

Figure 2:
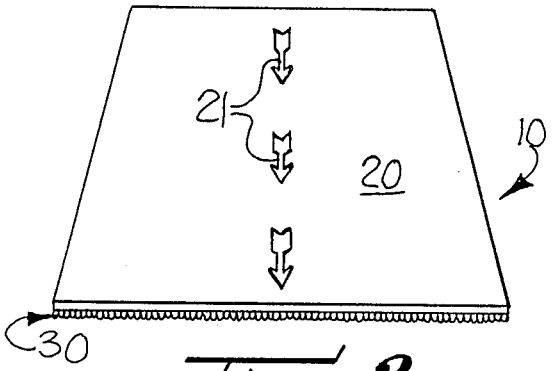
FIG. 2 is a schematic view of the back side of the tufted carpet tile of FIG. 1.
Figure 3:
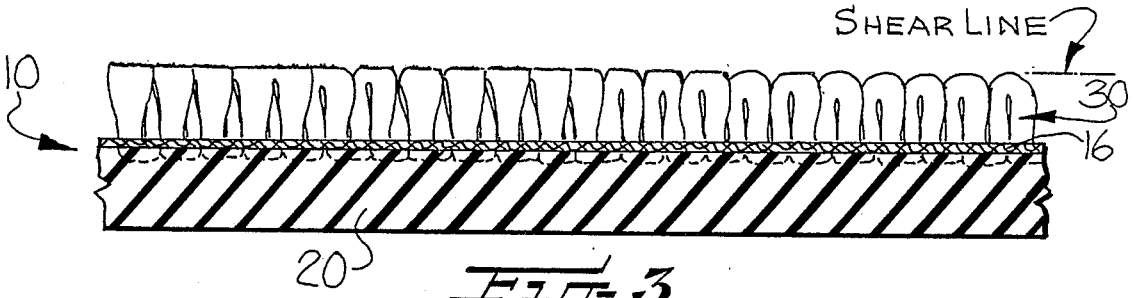
FIG. 3 is a schematic view taken along line 3-3 of the tufted carpet tile of FIG. 1 and illustrating that only some of the pile loop tufts are sheared, other loop tufts being uncut or only partially cut.

Referring now specifically to the drawings and the preferred embodiment of this invention illustrated therein, reference numeral 10 designates a tufted carpet tile having diagonal rows of pile tufts 14 and 15 arranged in alternation and extending across the fabric. The back side of the carpet tile 10 as illustrated in FIGS. 2 and 3 is provided with a relatively thick secondary backing 20, typically formed of foam plastic and serving to stabilize the tufted fabric and to provide the desired cushion to the carpet tile for comfort and prolonged carpet life. The secondary backing 20 is provided with indicia thereon shown in form of printed arrows 21 so as to assure that the carpet tiles are all laid in the same direction for uniform appearance; the direction of the arrows on all the carpet tiles being correlated to the grain of the tufted pile fabric.

Figure 5:
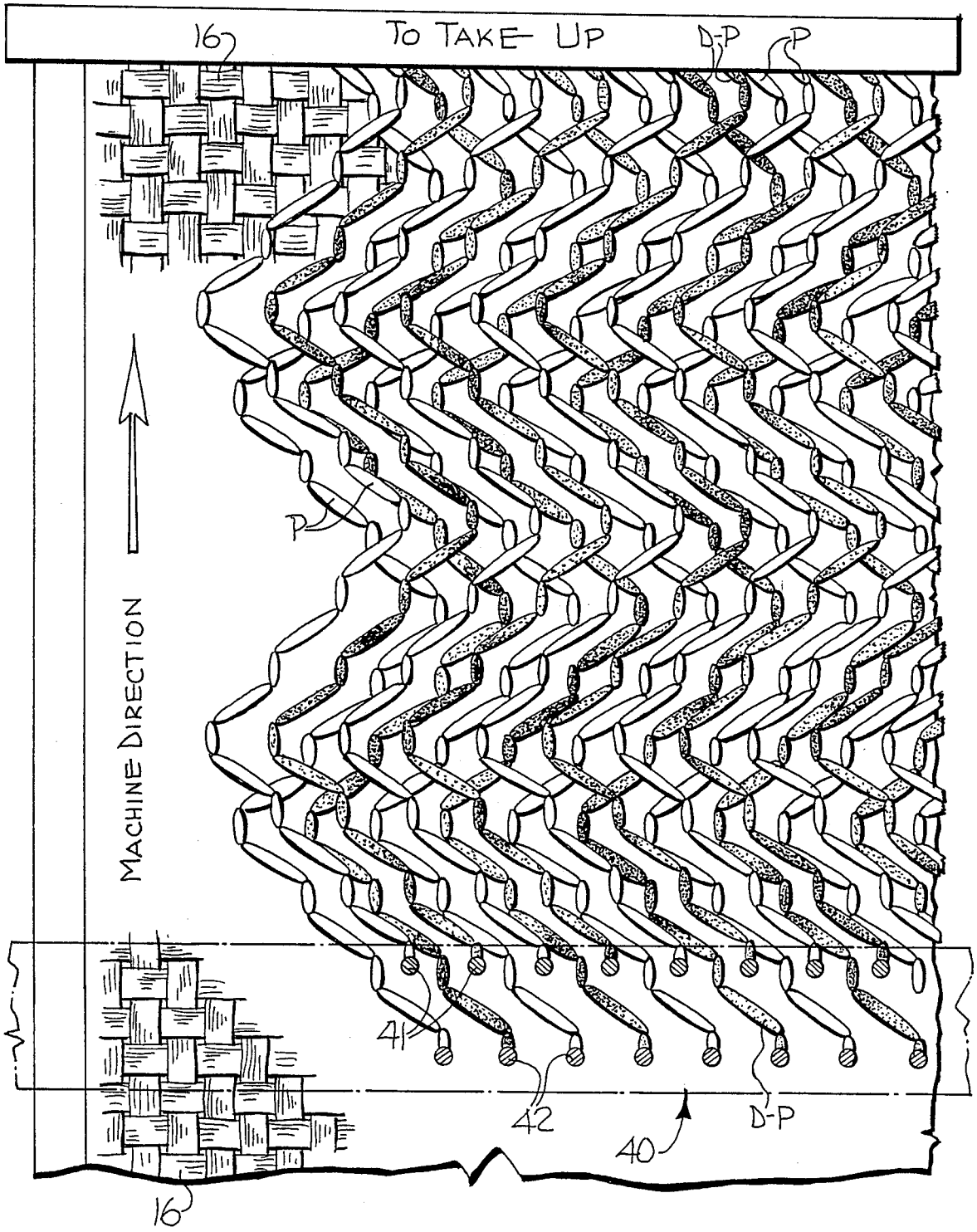
FIG. 5 is a schematic view of the back side of the tufted fabric of this invention being formed on a tufting machine equipped with a double row of needles on a single needle bar.

Referring now to FIG. 5 wherein the tufted fabric for forming the tufted carpet tile is schematically illustrated, reference numeral 30 broadly designates the tufted fabric which is formed by a single needle bar 40 having two rows of staggered needles 41, 42 thereon forming pile tufts on a primary backing 16. Alternate needles in each row have pile yarns of different characteristics differing in appearance from each other. Thus the draw of the pile yarns in the tufting machine is pairs of pile yarns P of a first characteristic alternating with pairs of pile yarns D-P of a different characteristic.

The pattern for effecting the diagonal rows of pile tufts 14 and 15 will be readily understood from FIG. 5 wherein it will be seen that the pattern is a zig-zag pattern with each repeat of the pattern including the needle bar 40 being shogged or stepped over three steps in one direction and then three steps in the opposite or return direction and with a repeated pile tuft being formed between each step-over of the pile yarns.

Figure 1:
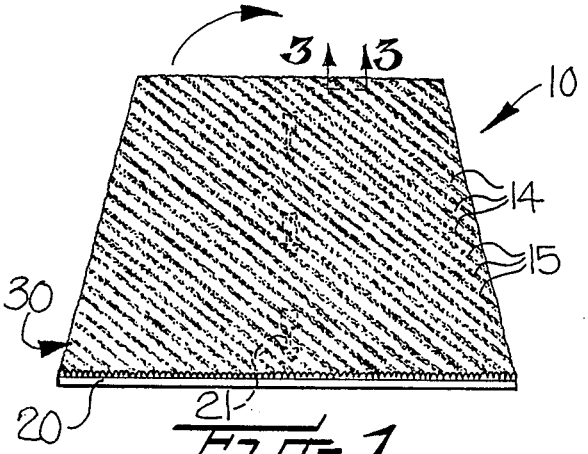
FIG. 1 is a schematic view of the face of a tufted carpet tile formed in accordance with this invention.
Figure 6:
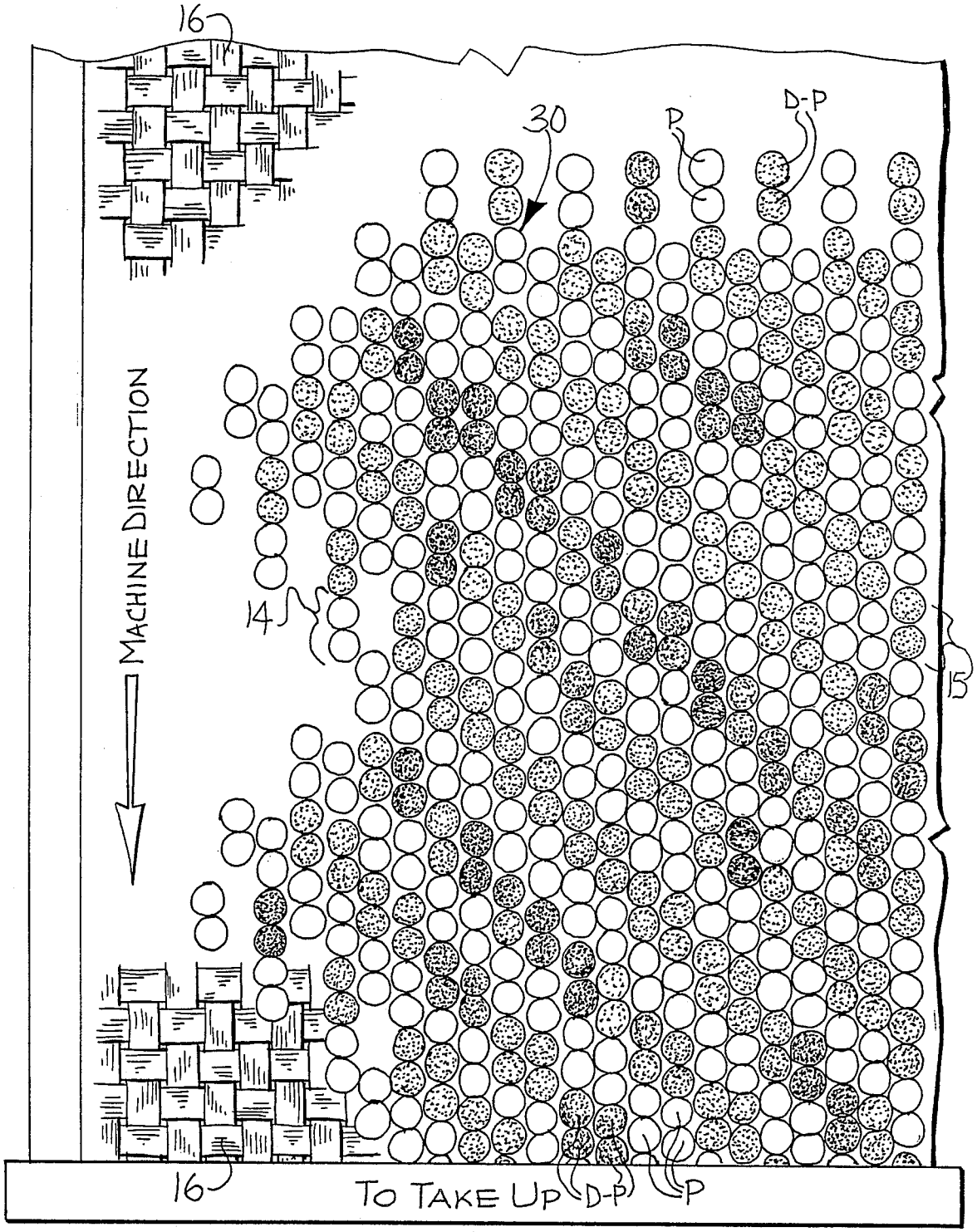
FIG. 6 is a schematic view of the face side of the tufted fabric illustrated in FIG. 5.

FIG. 6 schematically illustrates the face of the tufted pile fabric of FIG. 1, with diagonal lines of tufts as formed by the patterning schematically illustrated in FIG. 5.

Figure 4:
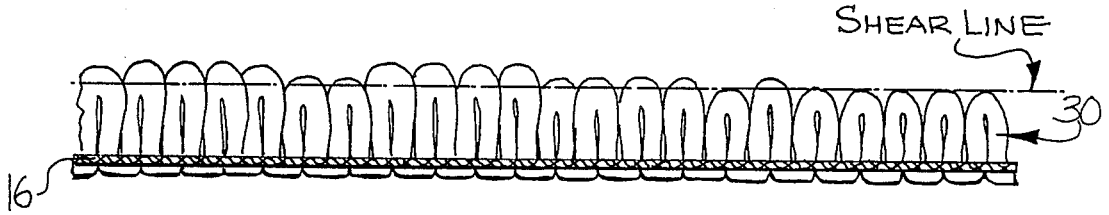
FIG. 4 is a schematic view similar to FIG. 3, but prior to the shearing operation and illustrating the irregular height loop pile and in broken lines the level of shearing of the pile loop tufts to obtain the sheared fabric level of FIG. 3 prior to the addition of the secondary carpet backing.

Referring now to FIGS. 3 and 4, the latter figure schematically illustrates the tufted fabric as the same comes off the tufting machine with random irregular or variable height pile. As will be noted, the piles are of three or more heights which is obtained by variable setting of the bed plate on the tufting machine so as not to obtain uniform height, which is normally the desired type pile fabric. As illustrated, some of the pile loops namely the highest loops are completely cut, other loops, namely the lowest are uncut. The intermediate height loops are partially cut so that only some of the continuous filaments forming the loop pile are severed.

Referring now more particularly to the nature of the tufting yarns, as indicated earlier, two types of pile yarns P and D-P are present. The pile yarns P are of a solid color and visually contrast with pile yarns D-P which are spaced dyed yarns having a series of different colored segments randomly arranged throughout the yarns. Desirably the length of each colored segment is within the range of 2 to 6 inches in length, with at least some of the segments of a given same color varying in length throughout the yarn. The pile yarns P and D-P may be of any suitable multifilament material such as nylon or polyester and are typically formed by plying two multifilament yarns together to obtain a more stabilized plied yarn. The pile yarns P and D-P may be of a size within the range of 2,000 to 4,000 denier and preferably about 2,500 denier. The pitch of the tufted fabric is preferably 10 i.e. ten tufting needles per inch in order to have the desired pile tuft density for formation of carpet tiles therefrom. In this respect, it is recognized that a pitch of less than 10 tufts per inch will oftentimes result in the juncture or seam line of adjacent tiles being seen, thus detracting from the appearance of the laid carpet tiles.

It will thus be understood that the patterns created in the tufted carpets of this invention by the alternate arrangement of solid color pile yarns with spaced dyed yarns presents uniquely distinctive tufted carpet fabrics heretofore unavailable, particularly for the formation of tufted carpet tiles therefrom.

In the drawings and specification there has been set forth a preferred embodiment of the invention, and although specific terms are employed, they are used in a generic and descriptive sense only and not for purposes of limitation.

That which we claim is:

1. A tufted pile fabric characterized by having diagonal lines of tufts of different colors across the face of the fabric, said fabric comprising a primary backing, first and second sets of pile yarns formed of continuous filaments and forming pile tufts connected to and extending upwardly from the primary backing and forming a pile face across the primary backing, said first set of pile yarns being of a first characteristic, said second set of pile yarns being of a second characteristic differing in appearance from said first characteristic, the yarns in said first set being of a substantially solid color throughout their lengths, the yarns in said second set being space dyed yarns having a series of different colored segments of yarn along their length and wherein the different colored segments are randomly arranged throughout the respective yarns, each set of pile yarns forming longitudinally extending zig-zag rows of pile tufts so arranged that the pile tufts formed from the yarns of said first set form first diagonal lines of pile tufts extending diagonally across the pile face of the fabric from one side of the fabric to the other and the pile tufts formed from the yarns of said second set form second diagonal lines of pile tufts alternating with said first diagonal lines of pile tufts across the pile face of the fabric and wherein the face of the fabric presents the overall appearance of cut pile fabric and wherein only some of the pile tufts are cut pile tufts and are randomly arranged throughout the fabric, and wherein the remaining pile tufts include randomly arranged uncut loop pile tufts and randomly arranged partially cut loop pile tufts with only some of the continuous filaments forming the loop pile being cut at the face of the fabric.

2. A tufted pile fabric according to claim 1 wherein said first diagonal lines of pile tufts each comprises a pair of solid colored yarns, and said second diagonal lines of pile tufts each comprises a pair of space dyed yarns.

3. A tufted pile fabric according to claim 1 wherein the length of each of said colored segments in said spaced dyed yarns is within the range of about 2 to 6 inches in length and wherein at least some of the segments of a given same color in any given yarn vary in length relative to each other.

4. A tufted fabric according to claim 1 wherein a resilient and relatively thick secondary backing is connected to and underlies the primary backing and the pile fabric is in the form of a carpet tile, and a directional arrow is imprinted on the backside of the secondary backing correlated to the grain of the pile fabric for facilitating the laying of carpet tile with the grain of the pile tufts of respective tiles lying in a common direction.

5. A tufted pile fabric according to claim 1 wherein each of said zig-zag rows of pile tufts comprises a repeat pattern of a plurality of successive step-overs of the pile yarns in a given direction and then an equal number of step-overs of the pile yarns in the opposite direction, and wherein there is a repeated pile tuft between each step-over of the pile yarns.

6. A tufted pile fabric according to claim 5 wherein each of said zig-zag rows of pile tufts comprises three successive step-overs of the pile yarns in each direction so that said repeat pattern comprises three pile yarn step-overs in one direction and then three pile yarn step-overs in the opposite direction.

7. A tufted carpet tile characterized by having diagonal lines of tufts of different colors across the face of the tile, said carpet tile comprising a primary backing, first and second sets of pile yarns each within the range of 2,000 to 4,000 denier and each formed of a plurality of continuous filaments and forming pile tufts connected to and extending upwardly from the primary backing and forming a pile face across the primary backing, a relatively thick secondary backing connected to and underlying the primary backing, said first set of pile yarns being of a first characteristic, said second set of pile yarns being of a second characteristic differing in appearance from said first characteristic, the yarns in said first set being of a substantially solid color throughout their lengths, the yarns in said second set being space dyed yarns having a series of different colored segments of yarn along their length and wherein the different colored segments are randomly arranged throughout the respective yarns, each set of pile yarns forming longitudinally extending zig-zag rows of pile tufts so arranged that the pile tufts formed from the yarns of said first set form first diagonal lines of pile tufts extending diagonally across the pile face of the fabric from one side of the fabric to the other and the pile tufts formed from the yarns of said second set form second diagonal lines of pile tufts alternating with said first diagonal lines of pile tufts across the pile face of the fabric and wherein the face of the fabric presents the overall appearance of cut pile fabric and wherein only some of the pile tufts are cut pile tufts and are randomly arranged throughout the fabric, and wherein the remaining pile tufts include randomly arranged uncut loop pile tufts and randomly arranged partially cut loop pile tufts with only some of the continuous filaments forming the loop pile being cut at the face of the fabric.

8. A tufted pile fabric according to claim 7 wherein each of said zig-zag rows of pile tufts comprises a repeat pattern of a plurality of successive step-overs of the pile yarns in a given direction and then an equal number of step-overs of the pile yarns in the opposite direction, and wherein there is a repeated pile tuft between each step-over of the pile yarns.

9. A tufted pile fabric according to claim 8 wherein each of said zig-zag rows of pile tufts comprises three successive step-overs of the pile yarns in each direction so that said repeat pattern comprises three pile yarn step-overs in one direction and then three pile yarn step-overs in the opposite direction.

* * * * *